US007302712B2

(12) United States Patent
Abrusia et al.

(10) Patent No.: US 7,302,712 B2
(45) Date of Patent: Dec. 4, 2007

(54) FASTENER MECHANISM FOR UNITING ARTICLES OF CLOTHING

(76) Inventors: Stephanie Abrusia, 33 Spencer Rd., Basking Ridge, NJ (US) 07920; Mary Piirsalu, 33 Spence Rd., Basking Ridge, NJ (US) 07920

( * ) Notice: Subject to any disclaimer, the term of this patent is extended or adjusted under 35 U.S.C. 154(b) by 429 days.

(21) Appl. No.: 10/867,924

(22) Filed: Jun. 15, 2004

(65) Prior Publication Data

US 2005/0273909 A1 Dec. 15, 2005

(51) Int. Cl.
*A41B 11/00* (2006.01)
*A41D 27/08* (2006.01)

(52) U.S. Cl. ..... 2/239; 24/DIG. 29; 2/244

(58) Field of Classification Search ..... 2/239, 2/244, 101, 160; 24/904, 335, 245, 279, 24/442, 306, DIG. 29, 303
See application file for complete search history.

(56) References Cited

U.S. PATENT DOCUMENTS

| | | | | | |
|---|---|---|---|---|---|
| 3,699,617 | A | * | 10/1972 | Hofmeister | 24/341 |
| 4,333,182 | A | * | 6/1982 | Seibt | 2/265 |
| 4,344,240 | A | | 8/1982 | Schiller | 40/20 |
| 4,682,389 | A | | 7/1987 | Callender | 24/599 |
| 5,038,413 | A | | 8/1991 | Ursino | 2/239 |
| 5,357,660 | A | | 10/1994 | Smith | 24/662 |
| 5,450,658 | A | * | 9/1995 | Hicks | 24/303 |
| 5,579,541 | A | * | 12/1996 | Christy et al. | 2/239 |
| 5,740,558 | A | * | 4/1998 | Messman | 2/239 |
| 5,974,590 | A | | 11/1999 | Stubbs | 2/239 |
| 6,003,212 | A | * | 12/1999 | Imahata | 24/581.1 |
| 6,012,203 | A | * | 1/2000 | Baron Pearson | 24/114.9 |
| 6,032,294 | A | | 3/2000 | Dean | 2/239 |
| 6,092,241 | A | | 7/2000 | Bellet | 2/239 |
| 6,163,938 | A | * | 12/2000 | Weber-Unger | 24/303 |
| 6,185,751 | B1 | | 2/2001 | Mason | 2/239 |
| 6,216,279 | B1 | * | 4/2001 | Ellingson | 2/239 |
| 6,237,158 | B1 | * | 5/2001 | Barbara | 2/239 |
| 6,279,169 | B1 | | 8/2001 | Reichle | 2/239 |
| 6,374,420 | B2 | | 4/2002 | Jossi | 2/239 |
| 2003/0106194 | A1 | | 6/2003 | Lo | 24/662 |

* cited by examiner

*Primary Examiner*—Alissa Hoey
(74) *Attorney, Agent, or Firm*—Ernest D. Buffy & Associates, LLC; Ernest D. Buff; Hanganet A. La Croix

(57) ABSTRACT

A fastener mechanism releasably unites articles of clothing, which are reliably kept in paired relationship throughout laundering and storage. The fastener mechanism has a first fastener component comprising a disk-shaped member having a body and a grooved portion circumferentially extending around the body. A second fastener component comprising a u-shaped member forms an aperture. The u-shaped member has a ribbed portion circumferentially extending there around to facilitate interlocking of the components. The first and second fastener components are permanently attached to the corresponding articles of clothing via an appending member. A protective concealment pocket is optionally included to house the fastening components when the articles of clothing are worn. The first and second fastener components may be attached to a single article of clothing and act as a releasable fastening device integrally thereon or serve to releasably unite separate clothing components functionally related and distinct.

18 Claims, 10 Drawing Sheets

FASTENER MECHANISM FOR UNITING ARTICLES OF CLOTHING

BACKGROUND OF THE INVENTION

1. Field of the Invention

The present invention relates to fasteners for uniting articles of clothing; and more particularly to a fastener mechanism having first and second fastener components that interlock to releasably unite clothing articles together during laundering and storage thereof.

2. Description of the Prior Art

Laundering of small frequently worn articles of clothing can become a time consuming event. In particular, articles that come in pairs, especially socks, commonly need to be replaced as one of a pair is lost during laundering or misplaced after wearing. The misplacement of these clothing articles results in consumer costs by way of replacement expenses, time, and aggravation.

Storing small frequently worn articles of clothing in an organized manner can also be difficult as these articles are prone to intermingling with other articles. In particularly, socks that are neatly folded and paired together in a drawer frequently become separated and disheveled when a person rifles through the drawer to retrieve another item. Frequently, consumers spend unnecessary time sorting, separating, and pairing these articles of clothing after laundering. Fastening mechanisms for temporarily attaching these articles of clothing together during laundering and storage provide a useful means for preventing the disappearance of one of the pair while alleviating tiresome sorting and pairing.

The fastening mechanisms heretofore devised and utilized for uniting articles of a pair together generally consist of basic snap-type fastening means and tongue-and-groove type fastening means. These fastening mechanisms do not provide optimal unification of the articles of clothing during the laundering process and share many disadvantages.

One major disadvantage of the fastening mechanisms heretofore devised and utilized is their propensity towards disengagement during the laundering process. Specifically, snap-type fastening means are inherently susceptible to separation during laundering as extreme forces are applied in opposing directions. Such forces are integral to the harsh conditions anticipated during laundering. As a result, the disclosed snap-type fastening means readily disengage, resulting in separation of the joined articles.

Another key drawback associated with the heretofore devised and utilized fastening mechanisms is the entanglement, and even tearing, of the joined articles of clothing and other clothing during laundering. Tongue-and-groove type fastening means heretofore devised and utilized are particularly vulnerable to such entanglements. Breakage of the fastening mechanisms or even tearing of the articles typically result due to the inflexible and flush attachment configuration of these tongue-and-groove mechanisms to the articles. Flush attachment of the fastener components to each of the corresponding articles results in a concentration of force at the local attachment point. Dispersion of this force is levied resulting in breakage of the mechanism, disengagement, or in extreme cases tearing of the article.

Flush attachment of the mechanism components to the articles of clothing not only cause disengagement and breakage, but also contribute to inefficient laundering. Due to this type of attachment to the socks, the socks of a pair are intimately in contact with one another. As a result, proper cleaning in the attachment regions is impaired, as the laundering detergents and water forces are not properly exposed to the attachment region. This flush attachment configuration is typical of the heretofore devised and utilized fastener mechanisms.

Another disadvantage of conventional article pairing fastening mechanisms is difficulty of concealing them from view when the articles are being worn. During wear, these fastening mechanisms are plainly visible and, due to frequent bodily contact, irritate the wearer's skin or snag articles of overlaying clothing. Problems associated with the discomfort and even injury, caused when such mechanisms make intimate contact with the wearer's person, are readily apparent.

One basic type of fastening mechanism utilized for attaching articles of a pair together comprises a basic snap-type fastening means. This fastening mechanism includes a first fastener having a generally circular part that provides a projection, and a second fastener having a generally circular part that provides an aperture. When engaged the projection fits into the aperture forming a snap-like fit. Representative fastening mechanisms of this type are disclosed in detail by U.S. Pat. Nos. 6,032,294; 6,092,241; 6,185,751 B1; 6,374,420 B2; and 5,038,413.

Each of U.S. Pat. Nos. 6,032,294, 6,092,241, 6,185,751 B1, and 6,374,420 B2 (herein the '420 patent) discloses a fastener for mating pairs of clothing items wherein there is at least one snap fastener mechanism having a spherical projection fitting into a corresponding spherical aperture. The '420 patent calls for partial concealment of the fastening mechanisms, but the projection portion is not covered during wear. U.S. Pat. No. 5,038,413 (herein the '413 patent) discloses several embodiments for the mechanism comprising the sock fastening means. In particular, the '413 patent sets forth the use of a snap-type fastener as discussed hereinabove. In alternative embodiments, the '413 patent discloses Velcro-type, button and buttonhole, and hook and an eyelet fasteners. The '413 patent discloses the placement of logos or designs to be snapped into the snap when worn; this calls attention to the wearer's leg region.

Other disclosures setting forth basic snap-type mechanisms function as identification and tagging devices for articles of clothing. These devices do not join two articles of clothing together, but act unilaterally with one of the articles of the pair. See U.S. Pat. Nos. 4,344,240; and 5,357,660. These disclosures set forth means for attaching an identification snap to articles of a pair and do not disclose fastening the pair together. Likewise, U.S. Pat. No. 6,279,169 B1 (herein the '169 patent) discloses a snap-type fastener utilized as a sock sorting and storage device. The '169 patent discloses utilization of a fastening mechanism for the storage of the articles of a pair and does not disclose, and in fact teaches away from, joining articles for laundering.

U.S. Pat. No. 5,974,590 to Stubbs generally discloses a fastening mechanism having a spherical lug projection that fits into a spherical corresponding aperture so that articles of a pair are joined for laundering. This fastening configuration is very similar to the snap-type fastening mechanisms. The lug projection snaps into the corresponding aperture and engagement of the fastening device is accomplished.

The tongue-and-groove type fastening mechanisms heretofore devised and utilized generally consist of a flat surface having a ribbed portion that is inserted into a corresponding cavity having a groove. See U.S. Pat. Nos. 4,682,389; and 6,237,158 B1. U.S. Pat. No. 4,682,389 (herein the '389 patent) sets forth a fastening mechanism comprising a first block-like element having a cavity (groove) opening at the top and extending downwardly, a second block-like element having a tongue downwardly insertable into the first said element, detent (locking) means within the first and second element, and a stud and washer attachment means for temporarily attaching the first and second elements to related garments. U.S. Pat. No. 6,237,158 B1 (herein the '158 patent) discloses a clip assembly fastening mechanism for joining a sock of a pair to prevent the socks form being separated when laundered or stored. The clip assembly is comprised of panels attached to each sock, preferably near the ankle portion. The panels include corresponding pluralities of wedge-shaped tongues on outwardly facing sides thereof with similarly shaped grooves formed therebetween. The two panels are joined by sliding the panels together.

Both the '389 and '158 patents disclose conspicuous square-shaped fastening components. The square-shaped components inherently present four sharp corner points, which not only attribute to the snagging of clothing, but may even cause physically injury to the wearer. Furthermore, the fastening mechanisms are not inconspicuously located. In fact the '138 patent discloses that the panels are to be placed in a visible area of the sock, suggesting that jewels may adorn the panels.

U.S. Patent Application Publication No. 2003/0105194 to Lo (hereinafter the '194 publication) discloses a fastening device for detachably fastening two members in a pair of articles, consisting of socks or gloves, together. Significantly, the '420 patent discloses a fastening mechanism comprised of a negative fastening member having a base panel, a spacer block, a cylindrical integral, and a retaining head; and a corresponding positive fastening member having a base panel, a socket with a transversely extended receiving hole. The device is engaged and the socks thereafter detachably joined when the retaining head and cylinder of the negative fastening member are received by the socket of the positive fastening member.

All of the above patent disclosures are similar and share the same drawbacks. The snap-type design is especially vulnerable to disengagement during laundering due to weak interlocking capabilities. Even where the heretofore devised and utilized fastening mechanisms do not disengage during laundering, entanglement, breakage, and tearing of the articles routinely occur. Furthermore, in each the forgoing patent disclosures, attachment of the fastening components brings a substantial portion thereof flush against the material of the clothing articles. With such an attachment configuration, disengagement, breakage, and inefficient laundering frequently result. None of the above fastening mechanisms provide for a concealment pocket in order to provide for the articles to be worn in an optionally protective inconspicuous manner, and therefore such mechanisms are prone towards catching on the wearer's person or overlaid clothing.

The heretofore disclosed and utilized fastener mechanisms for the releasable joining of articles of clothing, such as socks, do not disclose a fastener mechanism that allows omni-directional entry, and interlocking properties through use of a disk-shaped member and a u-shaped aperture. Rather, such conventional mechanisms utilize projecting members, together with spherical surfaces or tongue and groove type surfaces. None of the conventional mechanisms utilize a disk-shaped member inserted into a u-shaped member. Moreover, none of the fastening mechanisms heretofore disclosed utilize an optional decorative or inconspicuous protective concealment pocket for the fastening components.

For the foregoing reasons, there exists a need in the art for a fastener mechanism for temporarily uniting articles of clothing that is inexpensive to construct, comfortable and safe to use and highly reliable in operation. Specifically, there is needed, a fastener comprising a first fastening component having a disc-shaped member that interlocks with a second fastening component having a u-shaped aperture member. Also needed is a fastener mechanism comprising an appending member located on both the first and second fastening components for attaching the fastener components to the articles of clothing. Further needed is a fastener mechanism for uniting articles of clothing comprising an optional band of material functioning as a protective concealment pocket. It would be highly advantageous if the use of a disk-shaped member inserted into a u-shaped member would allow omni-directional entry and create an interlocking fastening mechanism that would remain engaged throughout the laundering process. It would also be advantageous if the fastening mechanism was not flush against the material of the article, but was attached to the articles by way of an appending member so as to suspend from the article of clothing. Further advantages would be derived if the fastening mechanisms optionally included a snap having the form of a preselected design. Still other advantages would be afforded by bands of material attached to paired articles of clothing so as to form protective concealment pockets wherein the fasteners are housed when the article is worn. These concealment pockets could be adorned with decorative designs or even have decorative shapes that further encourage their use.

SUMMARY OF THE INVENTION

The present invention provides a fastener mechanism for temporarily uniting articles of clothing that is inexpensive to construct, comfortable and safe to use and highly reliable in operation. A first fastening component having a disc-shaped member interlocks with a second fastening component having a u-shaped aperture member. The fastener mechanism comprises an appending member located on both the first and second fastening components for attaching the fastener components to the articles of clothing. Such an appending mechanism tends to absorb forces exerted on the mechanism, and protects the article of clothing with which it is associated during the washing and laundering process. An optional band of material functions as a protective concealment pocket. Insertion of the disk-shaped member into the u-shaped member is readily accomplished from substantially any direction, permitting omni-directional entry. Once connected, an interlocking action between the fastener components causes them to remain in an engaged condition throughout the laundering process. Advantageously, the fastening mechanism is not flush against the material of the article, but is attached thereto by way of an appending member that is suspended therefrom. With this arrangement, laundering and drying of the article is enhanced. The fastening mechanism optionally includes a snap having the form of a preselected design that adorns the snap and tends to encourage its use. A concealment means, comprising a plurality of bands of material attached to the paired articles of clothing form protective concealment pockets wherein the fasteners are housed when the article is worn. These concealment pockets can be adorned with decorative designs or even have decorative shapes that further encourage their use.

More specifically, there is provided in accordance with the invention, a fastener mechanism for releasably uniting articles of clothing and a process for using said fastener mechanism. Generally stated, the fastener mechanism comprises first and second fastening components that are readily engaged by insertion of the first fastening component into the second fastening component. The insertion is omnidirectional. An interlocking fastening mechanism is thereby engaged, and remains in the engaged condition throughout the laundering process.

Preferably, the fastener mechanism comprises a first fastening component having a disk-shaped member, and a second fastening component having a u-shaped member. The first and second fastener components are not flush against the material of the article; but rather are attached to the articles by appending members, so that the fastener components suspend therefrom. Optionally, a band of material is attached to each article of clothing, thereby forming a protective concealment pocket wherein the fasteners are housed when the article is worn. The optional concealment pocket may be adorned with a decorative design or even have a decorative shape. In addition, the concealment pockets may be camouflaged to blend with the articles' material, thereby providing inconspicuous protection for the fastener components during wear. Corresponding clothing components forming integral parts of a single article of clothing are advantageously paired and processed during laundering and storage using the fastener mechanism of the present invention.

In a preferred embodiment, the fastener mechanism of the present invention comprises a first fastener component attached to a first article of clothing. The first fastener component comprises a first appending member and a projecting disk-shaped member having a body and a grooved portion extending circumferentially around. A second fastener component is attached to a second article of clothing, and comprises a second appending member and a u-shaped aperture member with a ribbed portion extending circumferentially therein. The u-shaped aperture member and ribbed portion receive the first fastener component's disk-shaped member within the groove portion therein so as to create an interlocking relationship between the members. The appending members comprise an attachment means for affixing said first and second fastener components to articles of clothing to be united. Each of the first and second appending members has an aperture therein for receiving an attachment means for affixing said first and second fastener components to said first and second articles of clothing. The attachment means comprises a thread material that connects the fastener components to their respective clothing articles via sewing. Preferably the thread material is composed of an elastic material. The fastening mechanism is engaged when the disk-shaped member of the first fastener component is inserted into the u-shaped member of the second fastener component, thereby joining the corresponding articles of clothing together so as to maintain the union of the articles throughout the laundering and storing processes.

The first and second fastener components may be made from a thermostable plastic material or the like, so as to withstand the extreme torsions, water, and detergents implemented during the laundering process. The first and second fastener components can come in a variety of colors. Each of the first and second fastener components is affixed to an article of clothing by way of an appending member. When the articles of clothing are laundered or stored, they remain united since the fastening components are interlocked. The articles of clothing are of the type that come in pairs and are selected from the group consisting of socks, booties, mittens, gloves, and infant outfits.

Optionally, a band of material may be affixed to the articles of clothing by attachment means. The band of material is preferably square in shape, more preferably rectangular in shape, and thereby has two vertical sides, a horizontal top side, and a horizontal bottom side. The attachment means consists of sewing or the like and engages at least the two vertical sides of the band of material so that the band of material forms a pocket-like structure. Optionally, the band of material is attached to the first and second articles of clothing by engaging each of the two vertical sides and the horizontal bottom side so that the band of material forms a pocket-like structure. This pocket-like structure functions to house the first and second fastener components when disengaged and thereby conceals the fastener components while preventing contact with the wearer's person. The band of material is preferably composed of an elastic material having a height greater than or equal to the length of the first and second fastener components. The length of the band of material is greater than or equal to the width of said first and second fastener components. Optionally, the band of material may have an outer surface with a design or logo located thereon, and/or the band of material may have a design shape or logo.

Optionally, a decorative snap can be inserted into the first fastening component when the articles of clothing are being worn. Specifically, the first fastening component has an aperture for receiving a decorative snap when the articles of clothing are being worn. The decorative snap is comprised of a face portion having a design and a back portion having a projection. This projection is received by the aperture in the first fastening component. Correspondingly, a decorative disk shaped snap can be inserted into the second fastening component by inserting the decorative disk shaped snap into the second fastening component's u-shaped member when the articles of clothing are being worn. The decorative disk shaped snap comprises a disk-shaped body and a trenched portion extending circumferentially around said body, wherein said decorative disk shaped snap is received by said u-shaped member.

In another embodiment, the first and second articles of clothing with the first and second fastener components attached thereto, is a single article of clothing. In this embodiment the fastener components can be used for the fastening on a unilateral article of clothing. For example the fasteners can be used to unite sides of a jacket or hoods onto a jacket, or shirt lapels. The fastening components can also be used to releasably unite first and second articles that are integral to a single article of clothing having a body and straps, such as overalls, caps, dresses, pants, shorts, skirts, and shirts. The fastening components can also be used to releasably unite first and second articles that are integral to the function of a single article, such as belts, wrist bands, neck bands, or head bands. The fastening components can also be used to releasably unite first and second articles that are integral to a single article having a body and closure flap, such as pocketbooks, purses, tote bags, back packs, suitcases, and carrying bags. The fastening components can also be used to releasably unite first and second articles that are not integral to a single article, such as uniting a beach towel to a beach umbrella, a bath towel to a shower curtain, or a coat to a scarf.

The present invention also provides a process for using the fastener mechanism for releasably uniting articles of clothing. Generally stated, the process comprises the steps of: attaching a first fastener component to a first article of clothing, the first fastener component being comprised of a first appending member and a projecting disk-shaped member having a body and a grooved portion extending circumferentially around said body; attaching a second fastener component to a second article of clothing, the second fastener component being comprised a second appending member and a u-shaped aperture member having an inner surface provided with a ribbed portion extending circumferentially therealong. The u-shaped aperture member and ribbed portion are appointed to receive and hold the disk-shaped member in interlocking relationship within the groove portion.

The first and second articles of clothing are united when the first and second fastening components are engaged. Engagement of the fastening mechanism results when the first fastener component's projecting disk-shaped member is inserted into the second fastener component's u-shaped member. The united first and second articles of clothing are now ready for laundering. The articles remain united throughout the laundering and sorting, and optionally throughout the storage process. When the articles are to be worn, the fastening mechanism is disengaged by separating the first and second fastener components and thereby separating the first and second articles of clothing. Optionally, during wear, the fastener components can conveniently be stored in the concealment pocket formed by the attachment of a band of material to the articles of clothing. The length of the band of material is greater than or equal to the width of said first and second fastener components. Optionally, the band of material may have an outer surface with a design or logo located thereon, and/or the band of material may have a design shape or logo.

On the other hand, the fastening mechanisms may include a decorative snap and disk, for the first and second fastening components, respectively. Optionally, a decorative snap can be inserted into the first fastening component when the articles of clothing are being worn. Specifically, the first fastening component has an aperture for receiving a decorative snap when the articles of clothing are being worn. The decorative snap is comprised of a face portion having a design and a back portion having a projection. This projection is received by the first fastening component's aperture. Correspondingly, a decorative disk shaped snap can be inserted into the second fastening component by inserting the decorative disk shaped snap into the second fastening component's u-shaped member when the articles of clothing are being worn. The decorative disk shaped snap is comprised of disk-shaped body and a trenched portion extending circumferentially around said body, wherein said decorative disk shaped snap is received by said u-shaped member.

Optionally, another embodiment to facilitate the decoration of the fastener components involves the placing of a decorative plate on the exterior surface (visible) of the fastening components. For example, the first fastening component's disk-shaped member's body has a top surface where a decorative plate can be attached. The decorative plate is comprised of a face portion having a design and a back portion and is attached to the disk-shaped member body's top surface. The attachment means selected from the group consisting of hook and eye (Velcro), glue, or hook and loop. Correspondingly, the second fastening component's u-shaped member has a body with a top surface where a decorative plate is placed. The decorative plate is comprised of a face portion having a design and a back portion attached to said unshaped member body's top surface, the attachment means being selected from the group consisting of hook and eye (Velcro), glue, or hook and loop.

BRIEF DESCRIPTION OF THE DRAWINGS

The invention will be more fully understood and further advantages will become apparent when reference is had to the following detailed description, appended claims, and accompanying drawings, in which:

FIG. **9*a*-9*h* are schematic views of the Fastener Mechanism For Releasably Uniting Articles of Clothing showing other embodiments of the fastener mechanism as attached to a single article and acting integrally therein as a fastener.

DESCRIPTION OF THE PREFERRED EMBODIMENTS

This invention provides for a fastener mechanism that temporarily unites articles during laundering, use, and/or storage. The fastener mechanism is inexpensive to construct, easy to use, comfortable and safe to wear, and highly reliable in operation.

Generally stated, the fastener mechanism comprises a first fastening component having a disc-shaped member that interlocks with a second fastening component having a unshaped aperture member. An appending member is located on both the first and second fastening components for attaching the fastener components to the articles of clothing so that the fastening components are suspended from the article as opposed to flush attachment.

Advantageously, this attachment configuration forms a flexible point (i.e. at the attachment point) so that the first and second fastener components are flexibly attached to the first and second articles. When the articles are clothing, during laundering, this flexibility promotes dissipation of forces, so that the amount of tension and forces exerted upon the fastening mechanism and associated articles of clothing are lessoned. The attachment configuration is especially beneficial when laundering articles composed of delicate materials. Furthermore, the attachment configuration results in more efficient laundering by allowing the water and laundry detergents to penetrate the entire article of clothing. Significant advantages are thereby provided over fastener mechanisms having flush configurations, which result in inefficient laundering within the attachment area owing to the inability of water and laundry detergents to adequately penetrate that portion of the material covered by the attachment mechanism.

Where the articles are clothing, the arrangement of the present invention optionally promotes protective concealment of the fastening mechanisms during wear. A band of material attached to the articles of clothing forms a protective concealment pocket for the fasteners to be housed when the article is being worn. Advantageously, the band of material forms a protective concealment pocket so that the articles of clothing can be worn in a discrete manner. It also prevents the fastener components from jostling around and snagging on overlaying clothing. Importantly, the concealment pocket prevents the fastener components from coming into direct intimate contact with the wearer's leg, and alleviates potential discomfort or injuries, which may otherwise result.

Figure 1:
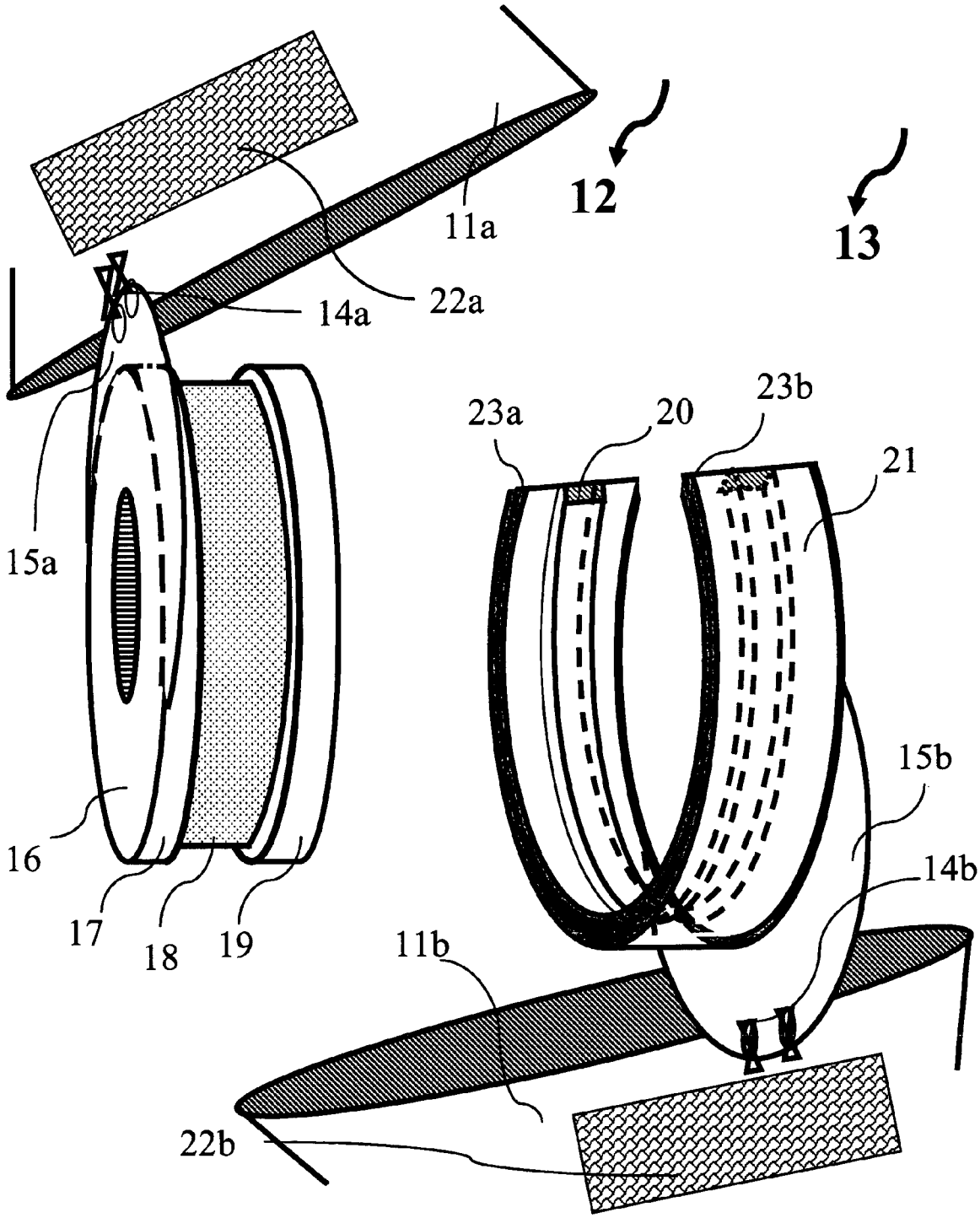
FIG. 1 is a schematic view of the Fastener Mechanism For Releasably Uniting Articles of Clothing in the disengaged position.

Referring to FIG. 1 of the drawings, the Fastener Mechanism For Releasably Uniting Articles of Clothing is shown in its disengaged configuration at 12 and 13. The first fastener component is shown generally at 12 and the second fastener component is shown generally at 13. First fastener component 12 is attached to a first article of clothing 11*a* and is comprised of a projecting disk-shaped member 16 having a body, and a first appending member 15*a*. The disk-shaped member 16 has a body with a grooved portion extending circumferentially thereon. This grooved portion is shown at 18. As shown, the disk-shaped member 16 is comprised of a front rim 17 and a rear rim 19 with a surface forming the inner groove portion 18 that extends circumferentially around the disk-shaped member 16. The disk-shaped member 16 snuggly inserts into the second fastener component 13. Advantageously, the disk-shaped member 16 can be inserted from whichever horizontal direction, regardless of side, into the second fastener component 13, thereby allowing omni-directional entry. The second fastener component 13 is attached to a second article of clothing 11*b*, and is comprised of a u-shaped member 21 and a second appending member 15*b*. The u-shaped member 21 provides an aperture for the insertion and housing of the disk-shaped member 16 of the first fastener component 12 upon engagement of the Fastener Mechanism For Releasably Uniting Articles of Clothing. A raised ribbed portion at 20 extends circumferentially around the length of the inner portion of the u-shaped member 21, having a width less than the inner portion of the u-shaped member 21, so as to form said ribbed portion 20. Said u-shaped member 21 and ribbed portion 20 are adapted to receive and interlock with disk-shaped member 16 of first fastener component 12. Interlocking is accomplished within groove portion 18 of first fastener component 12. Ribbed portion 20 protrudes from the inner surface of u-shaped member 21, to a raised elevation of approximately 1/32". Notably, the depth and width of the inner groove portion 18, located on the disk-shaped member 16 of the first fastener component, corresponds to the height and width of the inner ribbed portion 20 of the second fastener component 13 in order to form a snug fit. The first and second fastener components 12 and 13 are preferably made from a thermostable plastic material, so that the fastener components are light weight and have durable properties to withstand the rigors of laundering. The first and second fastener components 12 and 13 are preferably small in size, especially when used in connection with pairing small articles such as socks, with the height of the disk-shaped member 16 and the height of the u-shaped member 21 ranging from 1/16" to 1/4", preferably at a height of 1/8". Also, when utilized with such articles as socks the size of the first fastener component may range from 1/8" to 5/8" in width and 1/8" to 5/8" in length, most preferably for adult socks the first fastening component's width is 3/8" with a length of 1/2". Correspondingly, the second fastener component's width may range from 3/8" to 5/8" and its' height may range from 1/8" to 1/2", most preferably for adult socks the second fastening component's width is 1/2" with a height of 1/8". Notably, the width of the second fastening component is approximately 1/4" larger than the width of the first fastening component in order to facilitate an optimal fit. When the first and second articles 11*a* and 11*b* are socks, the disk-shaped member 16 preferably has a diameter of 1/2"; correspondingly, the u-shaped member 21 preferably has a diameter (lengthwise) of 3/8". Regardless of the article, the distance between the two prongs 23*a* and 23*b* of the unshaped member 21 is relative to the diameter of the disk-shaped member 16 in order to form a tight fitting configuration. Preferably, for example, where the disk-shaped member 16 is 1/2" in diameter, the u-shaped member's 21 two prongs 23*a* and 23*b* are located at a distance of 0.265" apart. In general, the sizes of the first and second fastener components are relative to the article to which they are attached. The fastening mechanism can be attached to various articles of clothing, including those clothing coming in pairs, such as socks, gloves, mittens, booties, baby outfits, and other small articles likely to come in pairs. Optionally, the first and second fastener components are attached to a single article and act as a fastening device thereon for the uniting of jacket or shirt lapels of fronts, or jacket to jacket hoods (see FIG. 9, discussed herein below). Optionally, the first and second fastener components are attached to non-clothing articles and act as a fastening device thereon (see FIG. 9, discussed herein below). Alternatively, the first and second articles to which the first and second fastener components are attached are different articles, but are functionally related articles (see FIG. 10, discussed herein below).

Continuing on FIG. 1, upon insertion of the disk-shaped member 16 into the aperture provided by the unshaped member 21 the first and second fastener components 12 and 13 interlock with the insertion of the inner groove portion 18 into the inner ribbed portion 20. The first and second appending members 15*a* and 15*b* correspondingly found on both the first fastener component 12 and the second fastener component 13 operates to permanently affix the first and second fastener components 12 and 13 to the corresponding articles of clothing through attachment means 14*a* and 14*b*, respectively. Preferably, the attachment means 14*a* and 14*b* comprises a plurality of threads generated by a sewing operation. Notably, the appending members 15*a* and 15*b* function to affix the first and second fastener components to the article in a suspended configuration, as opposed to flush attachment of the whole fastening component. Optionally, the first and second appending members 15*a* and 15*b* have at least two holes for attachment means 14*a* and 14*b*, such as sewing. When sewing is used the threads pass through the articles of clothing 11*a* and 11*b* and into the attachment means 14*a* and 14*b* (in this case holes), forming a strong lasting attachment to the garment. Optionally, elasticized thread may be used to provide even greater flexibility at the attachment point. The first and second fastening components 12 and 13 can be affixed, by way of the first and second appending members 15*a* and 15*b*, on the inner surface of the article, or more preferably on the outer surface of the article.

Conveniently the first fastener component 12 and the second fastener component 13 are permanently affixed to the articles of clothing 11*a* and 11*b*, allowing the user to immediately engage the fastener mechanism by readily inserting the disk-shaped member 16 of the first fastener component 12 into the aperture provided by the u-shaped member 21 of the second fastener component 13, and toss the joined unit into the hamper for later laundering. The insertion is omni-directional along the horizontal axis of the first and second fastening components 12 and 13 for convenient engagement. Furthermore, the first and second fastener components 12 and 13 disengage with ease when the user desires to wear the articles of clothing 11*a* and 11*b*. By applying force and pulling the first and second fastener components 12 and 13 in opposing directions, the Fastener Mechanism For Releasably Uniting Articles of Clothing is disengaged and the articles 11*a* and 11*b* are ready for wear. Optionally, when worn the first and second fastener components can readily be placed within a protective concealment pocket-like structure formed by attachment of a band of material. Preferably the band of material is to be made of an elastic material and fixed to the article of clothing in close proximity to the first and second fastener components 12 and 13. This band of material is shown at 22*a* and 22*b* for the first and second fastener components, respectively. The band of material 22*a* and 22*b* is attached to the article of clothing via sewing (or the like) the two vertical parallel side portions to the article in order to form a pocket-like structure. Optionally, the bottom portion may also be sewn to the article of clothing to form the pocket-like structure. The size of the band of material 22*a* and 22*b* is proportionally larger than the size of the first and second fastening components 12 and 13. For example, where the articles of clothing are sock matches, where the first and second fastening components are ≧½"×½" and 9/16"×½", respectively, the band of material 22*a* and 22*b* has approximate dimensions of ≧½"×9/16" (length×height). Preferably, the band of material 22*a* and 22*b* has approximate dimensions of ≧1½×¾" (length×height), in order to allow sufficient room for each of the first and second fastening components. Optionally, the band of material 22*a* and 22*b* can have design or logo on the exterior, or have a design shape or logo shape for aesthetics (discussed further in FIG. 4 herein).

Figure 2:
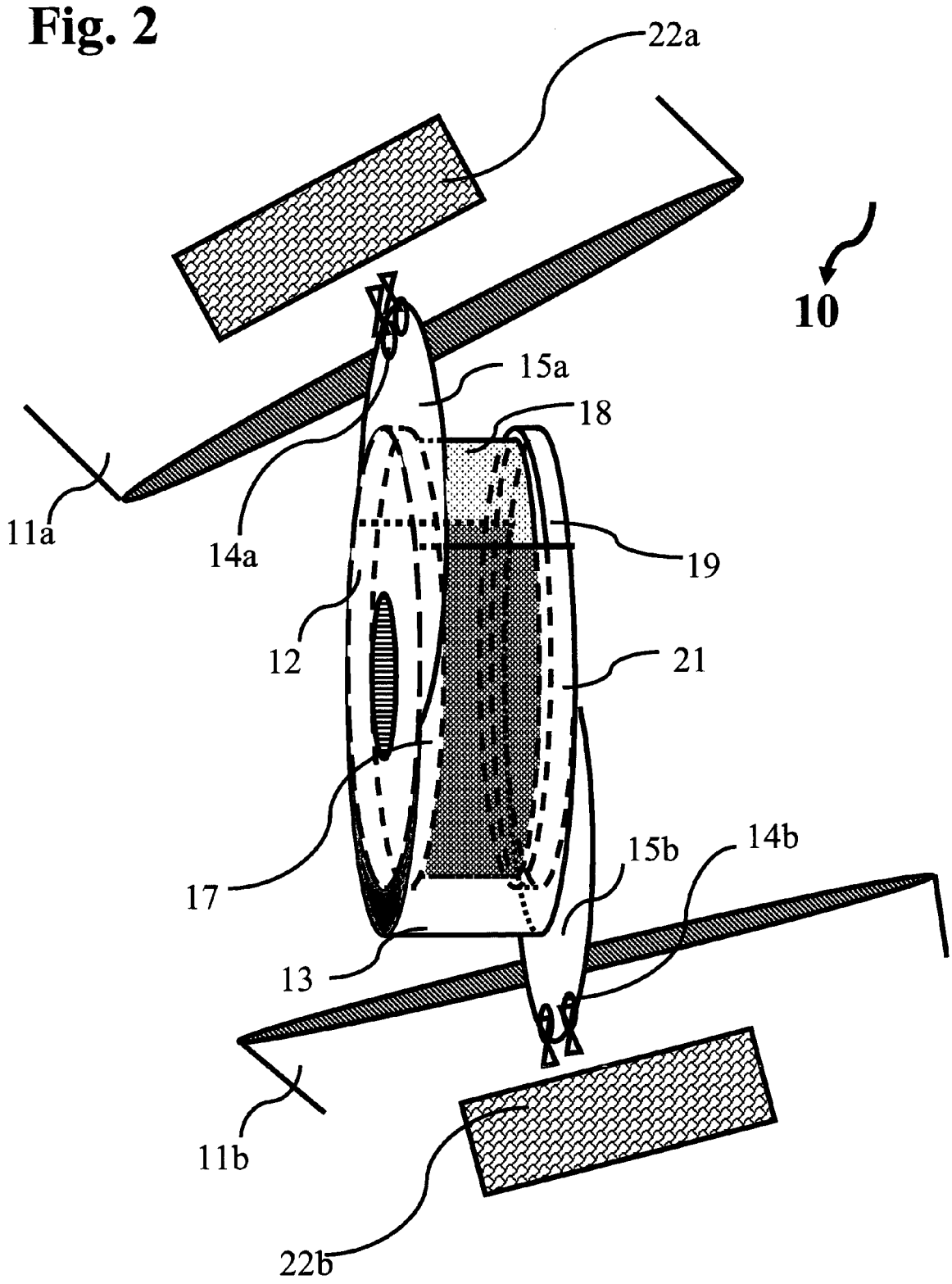
FIG. 2 is a schematic view of the Fastener Mechanism For Releasably Uniting Articles of Clothing in the engaged position.

A schematic diagram of the Fastener Mechanism For Releasably Uniting Articles of Clothing is shown generally at 10 in FIG. 2. As shown vertically, the Fastener Mechanism For Releasably Uniting Articles of Clothing is engaged, joining the articles located at 11*a* and 11*b* to denote a united relationship. In the engaged configuration the first fastener component 12 and the second fastener component 13 are interlocked and union of the articles 11*a* and 11*b* is accomplished. The articles 11*a* and 1*b* are attached to the first fastener component 12 and the second fastener component 13 through attachment means, such as sewing, located at 14 directly on the first and second appending members 15*a* and 15*b*.

Figure 3:
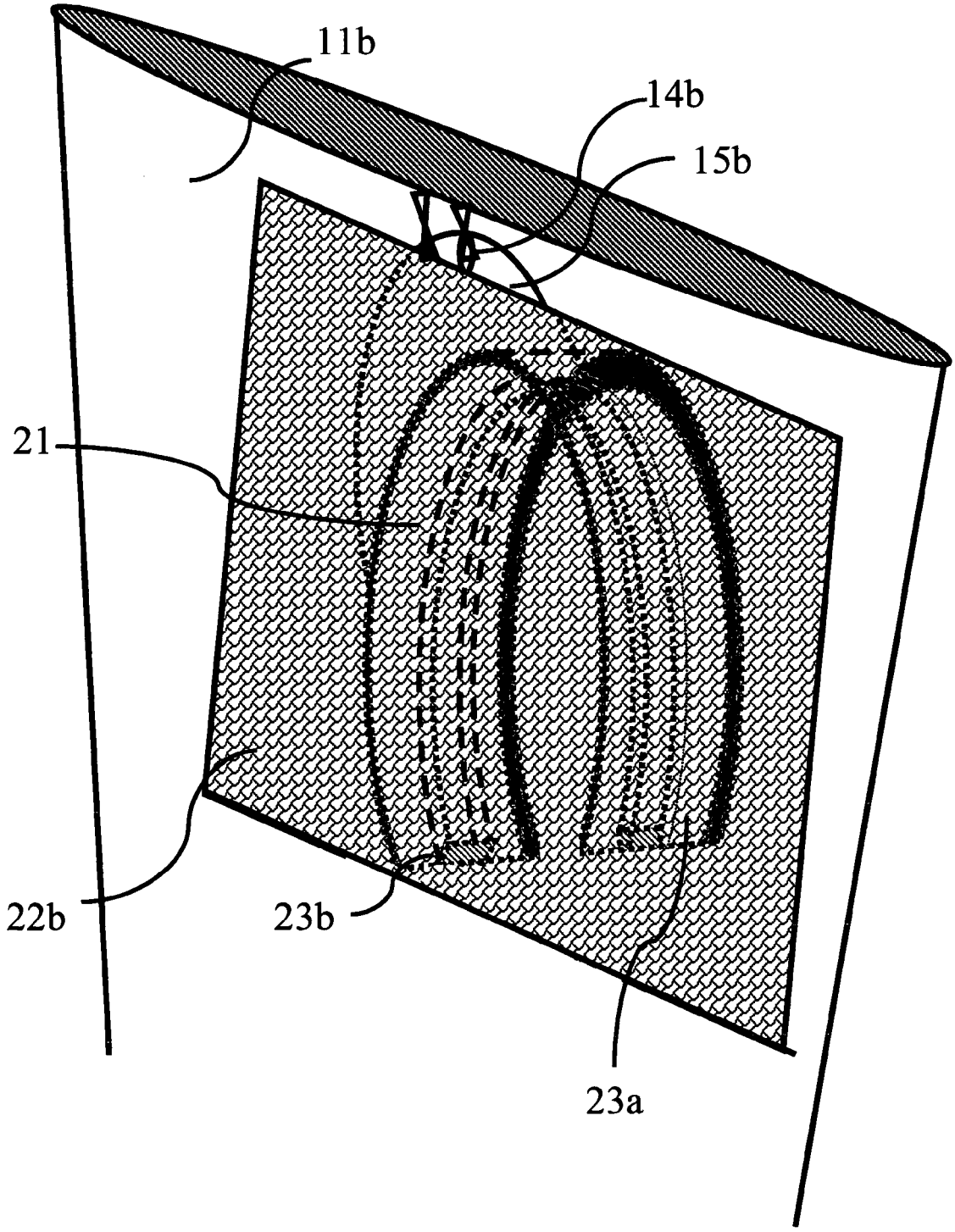
FIG. 3 is a schematic view of the Fastener Mechanism For Releasably Uniting Articles of Clothing showing the optional concealment of the fastener components when disengaged.

A schematic diagram of the Fastener Mechanism For Releasably Uniting Articles of Clothing is shown in FIG. 3, showing the optional use of a band of material functioning as a protective concealment pocket. Optionally a protective concealment pocket via a band of material is located on each article of clothing 11*a* and 11*b*, as also shown on FIG. 1 and FIG. 2 at 22*a* and 22*b* and schematically shown herein in FIG. 3. When wearing the articles of clothing 11*a* and 11*b* the first and second fastener components 12 and 13 are conveniently stowed away in these protective concealment pockets via bands of material 22*a* and 22*b*, respectively. The figure shows the concealment of the second fastener component 13, but the same can be said for the concealment of the first fastener component 12 although not shown. The band of material 22*a* and 22*b* forming the protective concealment pocket is fixed to the articles of clothing 11*a* and 11*b* by attachment means, such as sewing. The band of material 22*a* and 22*b* forms a pocket-like structure by attaching the two vertical sides of the band of material 22*a* and 22*b*, optionally the bottom side of the band of material 22*a* and 22*b* may also be attached to the article. Particularly, the band of material 22*a* and 22*b* is located in close proximity to the first fastening component 12 and the second fastening component 13 so that the components can easily be tucked into the protective concealment pocket 22*a* and 22*b* during wear.

Figure 4:
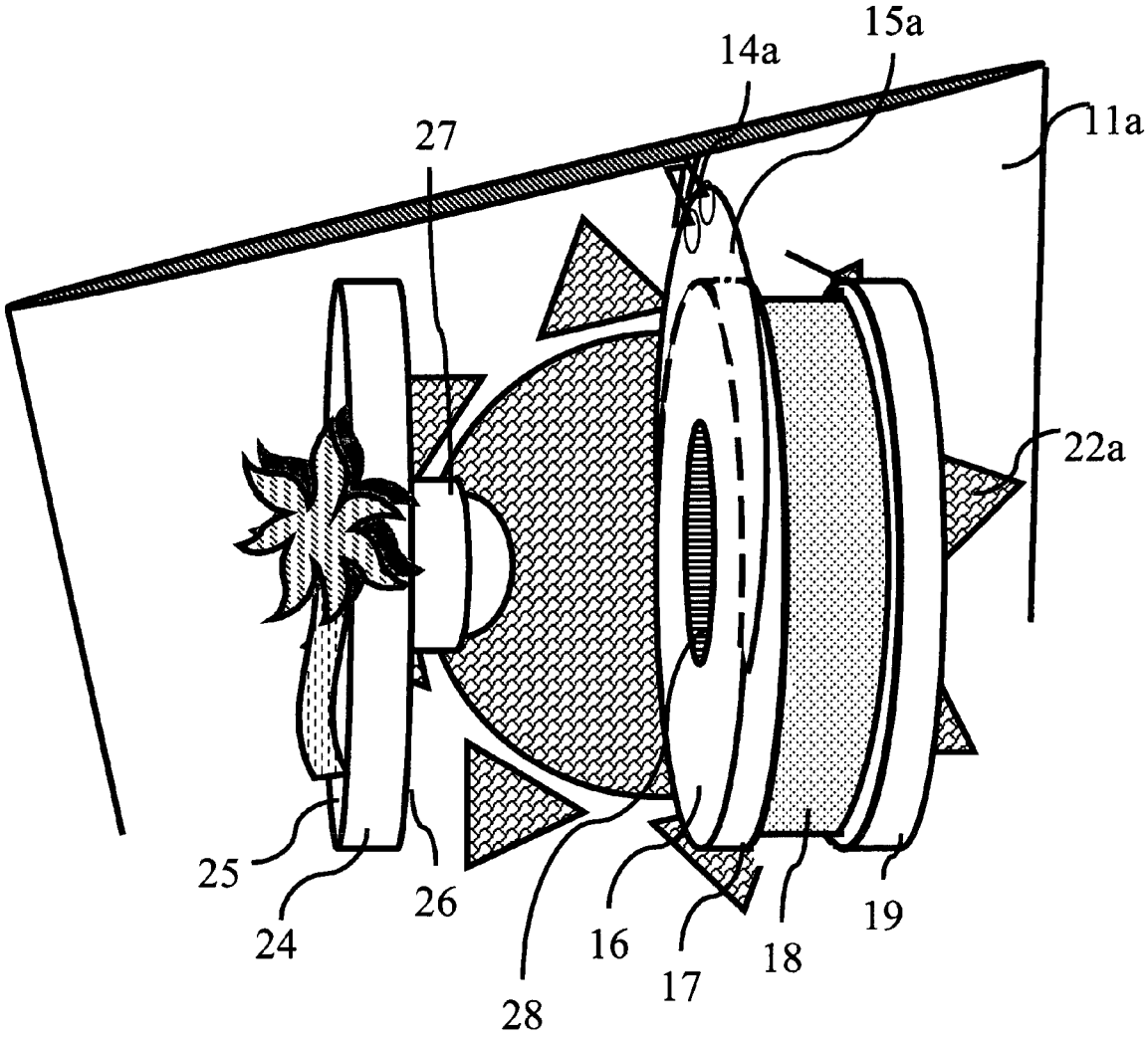
FIG. 4 is a schematic view of the Fastener Mechanism For Releasably Uniting Articles of Clothing showing the optional decoration of the first fastening component when the fastening mechanism is disengaged.

A schematic view of the Fastener Mechanism For Releasably Uniting Articles of Clothing showing the optional decoration of the first fastening component is shown in FIG. 4. When the article of clothing 11*a* is being worn a decorative snap 24 can be releasably attached to the first fastening component 12. Specifically, the first fastening component 12 has an aperture at 28 for receiving the decorative snap 24. The decorative snap 24 is comprised of a face portion 25 having a design and a back portion 26. The back portion 26 has a projection 27 protruding there from. Projection 27 is received into the aperture 28 to form a snug fit by snapping decorative snap 24 over the exterior face of the first fastening component 12. Notably the design located on the face portion 25 of the decorative snap 24 can comprise any decorative form. For example, the design can be a logo, characters, animals, fruit, or any such design. The design can also be jeweled designs. Also, the band of material 22*a* forming the concealment pocket discussed herein above, can be shaped to correspond to the design located on the face portion 25 of the decorative snap 24. For example, herein the design shown on the face portion 25 is a palm tree and the band of material 22*a* is shown in the shape of a sun.

Figure 5:
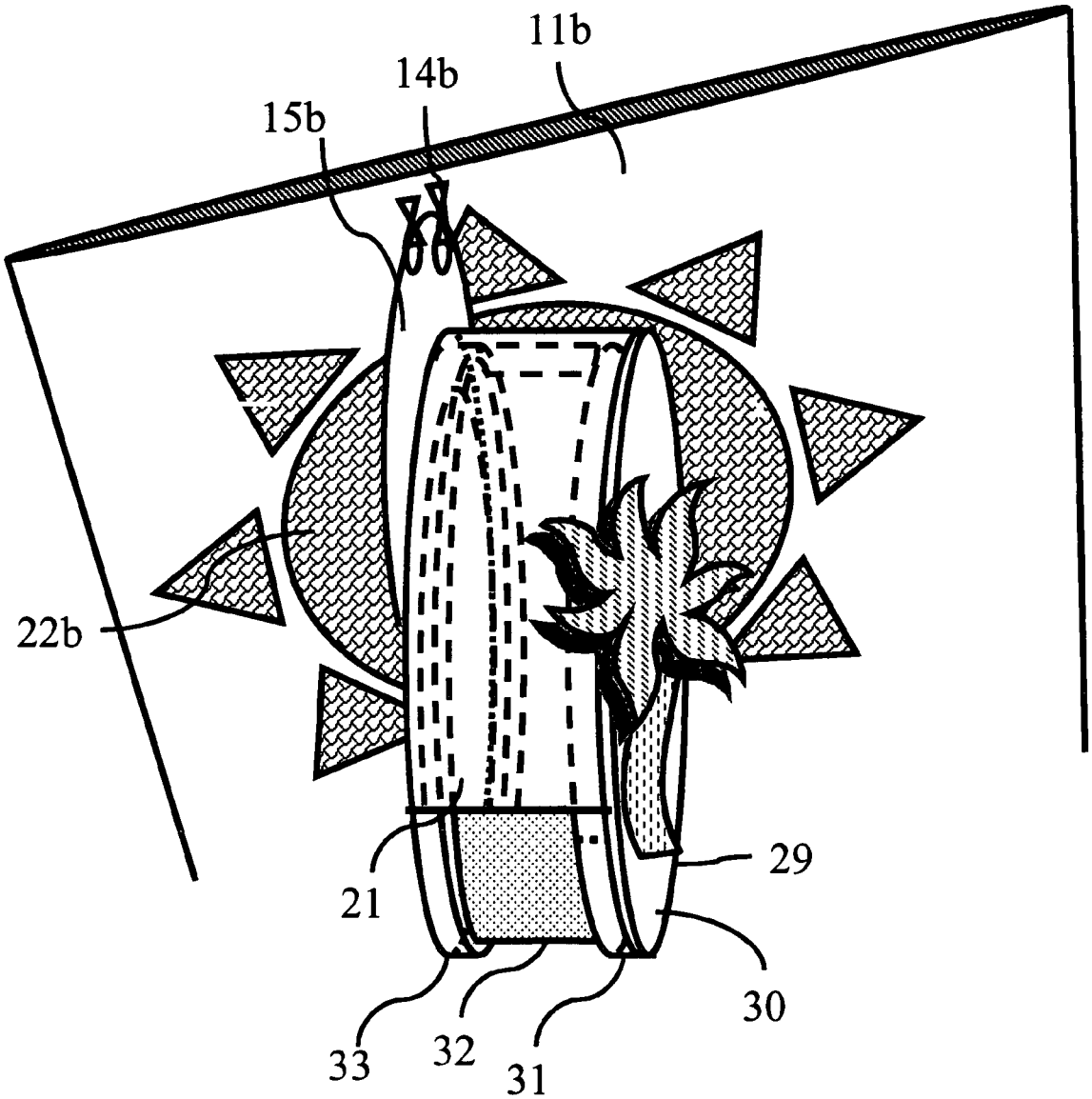
FIG. 5 is a schematic view of the Fastener Mechanism For Releasably Uniting Articles of Clothing showing the optional decoration of the second fastening component when the fastening mechanism is disengaged.

A schematic view of the Fastener Mechanism For Releasably Uniting Articles of Clothing showing the optional decoration of the second fastening component is shown in FIG. 5. When the article of clothing 11*b* is being worn a decorative disk shaped snap 29 can be releasably attached to the second fastening component 13. Specifically, the decorative disk shaped snap 29 is inserted into the u-shaped member 21 comprising the second fastener component 13. The decorative disk shaped snap 29 has a top face surface 30 that has a design thereon. This design can take any designated form and corresponding may match or relate to the design located on the decorative snap 24 associated with the first fastening component 12 (discussed herein in FIG. 4 above).

Figure 6:
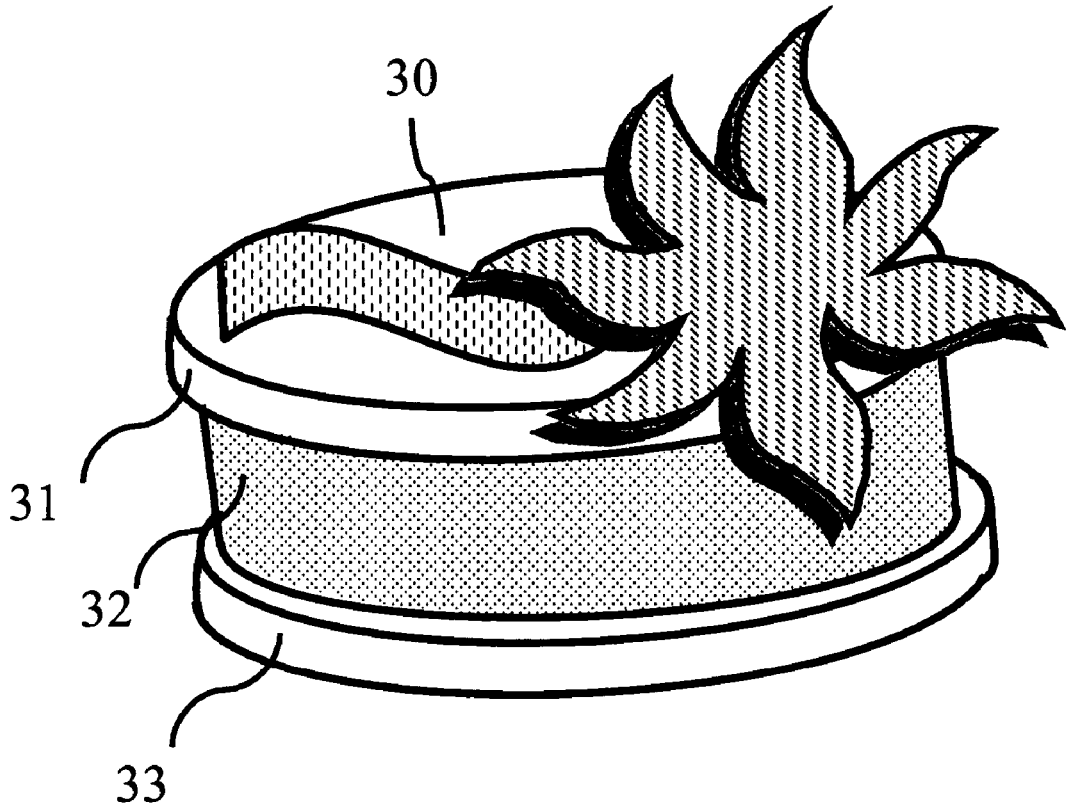
FIG. 6 is a schematic view of the Fastener Mechanism For Releasably Uniting Articles of Clothing showing the optional decorative disk shaped snap received by the second fastening component when the fastening mechanism is disengaged.

FIG. 5 is better understood with reference to FIG. 6. In FIG. 6 there is shown a schematic view of the Fastener Mechanism For Releasably Uniting Articles of Clothing. Optional decorative disk shaped snap 29 is received by the second fastening component when the fastening mechanism has the configuration discussed herein above in FIG. 5. The decorative disk shaped snap 29 has a body with a trenched portion extending circumferentially thereon. This trenched portion is shown at 32. As shown, the decorative disk shaped snap 29 is comprised of a surface exterior face 30, a top rim 31 and a bottom rim 33 with a surface forming the inner trenched portion 32 that extends circumferentially around the body of the decorative disk shaped snap 29. The decorative disk shaped snap 29 snuggly inserts into the second fastener component's 13 u-shaped member 21. As stated in the description of FIG. 1, there is a raised ribbed portion 20 that extends circumferentially around the length of the inner portion of the u-shaped member 21 of the second fastener component 13. The u-shaped member 21 provides an aperture for the insertion and housing of the decorative disk shaped snap 29 upon decoration of the second fastening component 13. Like the first fastening component, the depth and width of the decorative disk shaped snap 29 trenched portion 32 is dependant on the height and width of the raised ribbed portion 20 of the u-shaped member 21. As a result, trenched portion 32 of decorative disk shaped snap 29 receives the raised ribbed portion 20 of the u-shaped member 21 to form a snug fit, and thereby functions to decorate the second fastening component 13. The surface exterior face 30 contains a decorative design, herein shown as a palm tree.

Figure 7:
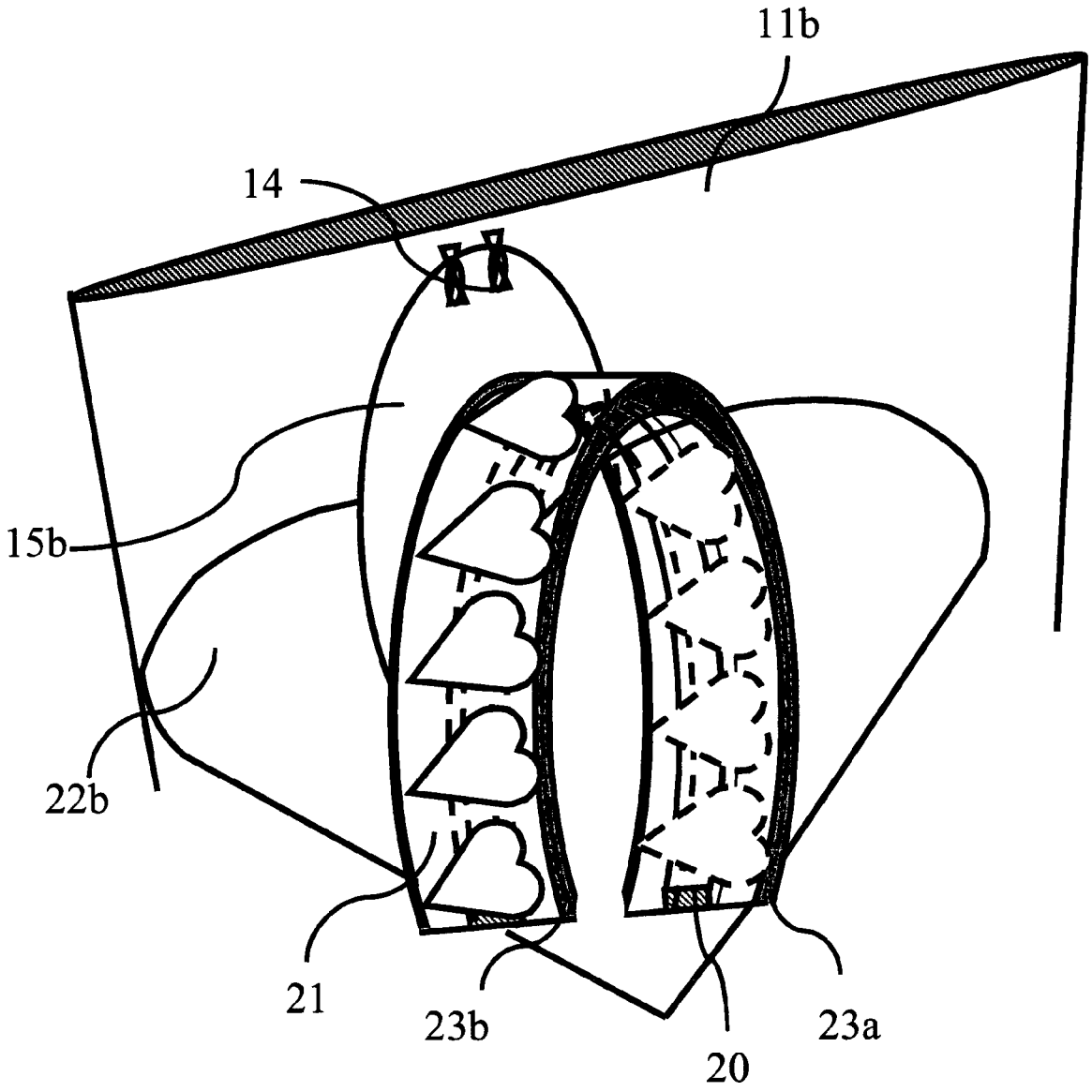
FIG. 7 is a schematic view of the Fastener Mechanism For Releasably Uniting Articles of Clothing showing the optional decoration of the second fastening component when the fastening mechanism is disengaged.

FIG. 7 shows a schematic view of the Fastener Mechanism For Releasably Uniting Articles of Clothing shows the optional decoration of the second fastening component 13 when the fastening mechanism is disengaged. Accordingly, a decorative design can be permanently attached or etched within the material used to form the second fastening component 13. The decoration is permanently attached to the u-shaped member 21. Herein the design is shown as a string of hearts, but any design is acceptable. The appending member 15*b* can also have the design. The design can be attached by glue or melded within the thermoplastic material forming the fastening components 12 and 13. The band of material 22*b* forming the concealment pocket can also have a design, herein it is shown as a heart shape. The design can be jeweled. Correspondingly, although not shown, the first fastening component 12 can also have an etched or permanently attached design on the exterior surface of its disk-shaped member 16.

Figure 8:
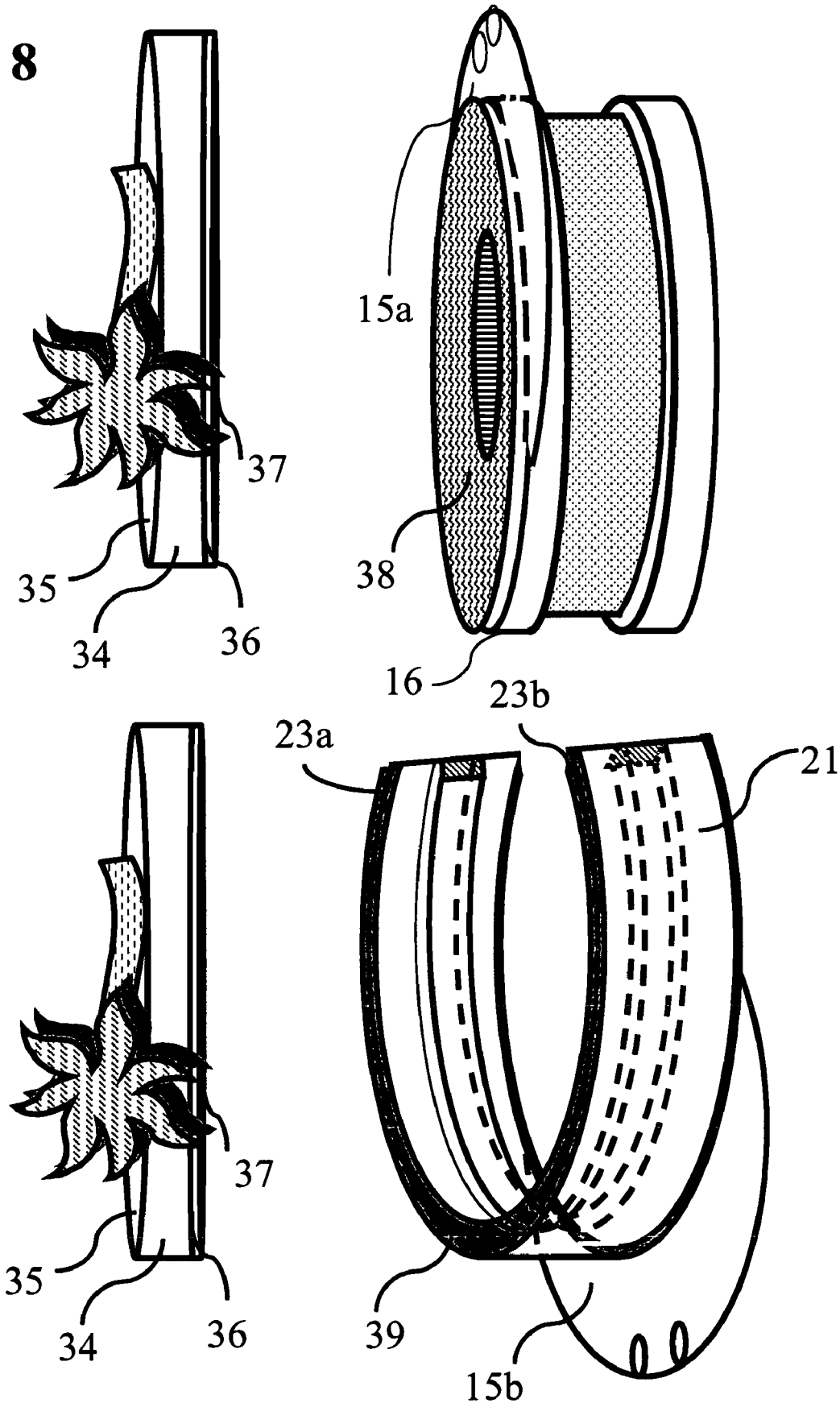
FIG. 8 is a schematic view of the Fastener Mechanism For Releasably Uniting Articles of Clothing showing another embodiment of the optional decoration of the first and second fastening components when the fastening mechanism is disengaged.

An alternative decoration of the first and second fastening components 12 and 13 is shown in FIG. 8. Specifically, FIG. 8 is a schematic view of the Fastener Mechanism For Releasably Uniting Articles of Clothing showing another embodiment of the optional decoration of the first and second fastening components when the fastening mechanism is disengaged and being worn. When the articles of clothing 11*a* and 11*b* are being worn a decorative plate 34 can be releasably attached to the first and second fastening components 12 and 13. Specifically, the decorative plate 34 has a body having a top surface 35 and a bottom surface 36. The top surface 35 has a design located thereon. The bottom surface 36 has a decorative attachment means 37 permanently affixed to the bottom surface 36 by glue. The decorative attachment means 37 is selected from the group consisting of hook and eye (Velcro), glue, or hook and loop. This decorative attachment means 37 is correspondingly found on the first and second fastening components top surfaces 38 and 39, respectively. Particularly, where the attachment means if hook and eye, the first fastening component's 12 disk shaped member 16 has a hook or loop (vis-a-vis the decorative plate 34) attached to the top exterior surface 38; the second fastening component 13 has a hook or loop (visa vi the decorative plate 34) attached to its top exterior surface 39.

Figure 9A:
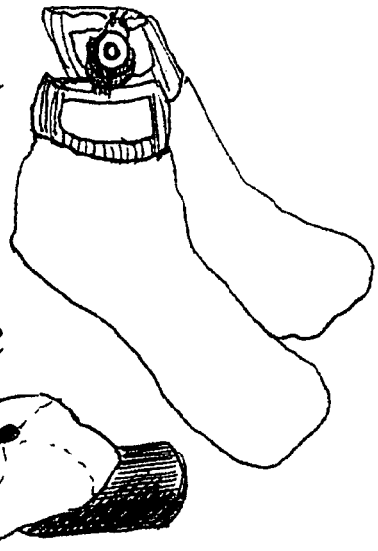
Figure 9B:
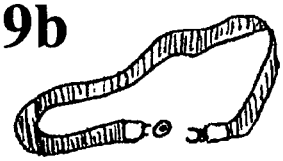
Figure 9C:
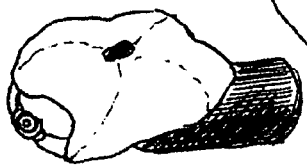
Figure 9D:
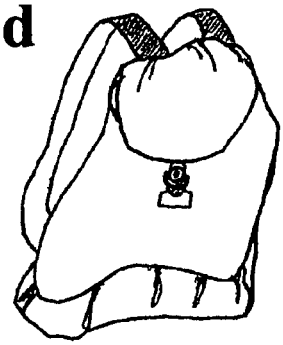
Figure 9E:
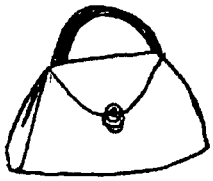
Figure 9F:
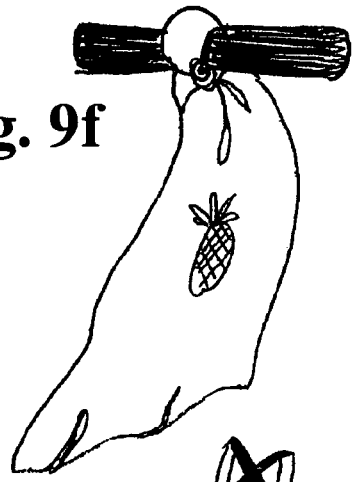
Figure 9G:
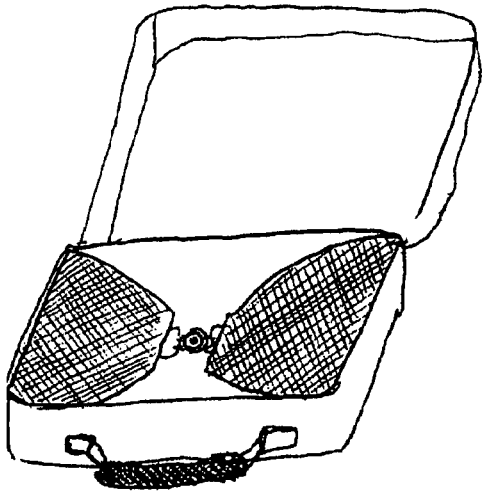
Figure 9H:
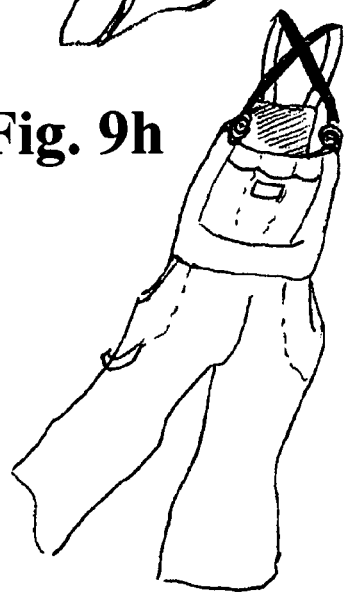

Schematic views of the Fastener Mechanism For Releasably Uniting Articles of Clothing showing other embodiments of the fastener mechanism, as attached to a single article and acting integrally therein as a fastener, are shown in FIGS. 9*a* through 9*h*. FIG. 9*a* shows the fastener mechanism as used to unite a pair of socks. FIG. 9*b* shows the fastener mechanism used on a belt in order to close the belt, similar articles can also be used, such as wrist bands, neck bands, or head bands. FIG. 9*c* shows the fastener mechanism used on a cap. FIG. 9*d* shows the fastener mechanism used as a closure for a backpack. FIG. 9*e* shows the fastener mechanism used as a closure for a purse or pocket book. It will be understand that the closure depicted by FIG. 93 can alternatively be applied to a variety of related articles, including those selected from the group consisting of tote bags, back packs, suitcases, and carrying bags. FIG. 9*f* shows the fastener mechanism used on a kitchen towel in order to releasably attach the kitchen towel to a handle of a kitchen appliance, such as an oven handle. FIG. 9*g* shows the fastener mechanism used on the inner flaps of a suit case or piece of luggage. FIG. 9*h* shows the fastener mechanism on a pair of overalls used to hold the straps to the body thereof, other examples include articles of clothing selected from the group consisting of dresses, pants, shorts, skirts, and shirts.

Figure 10:
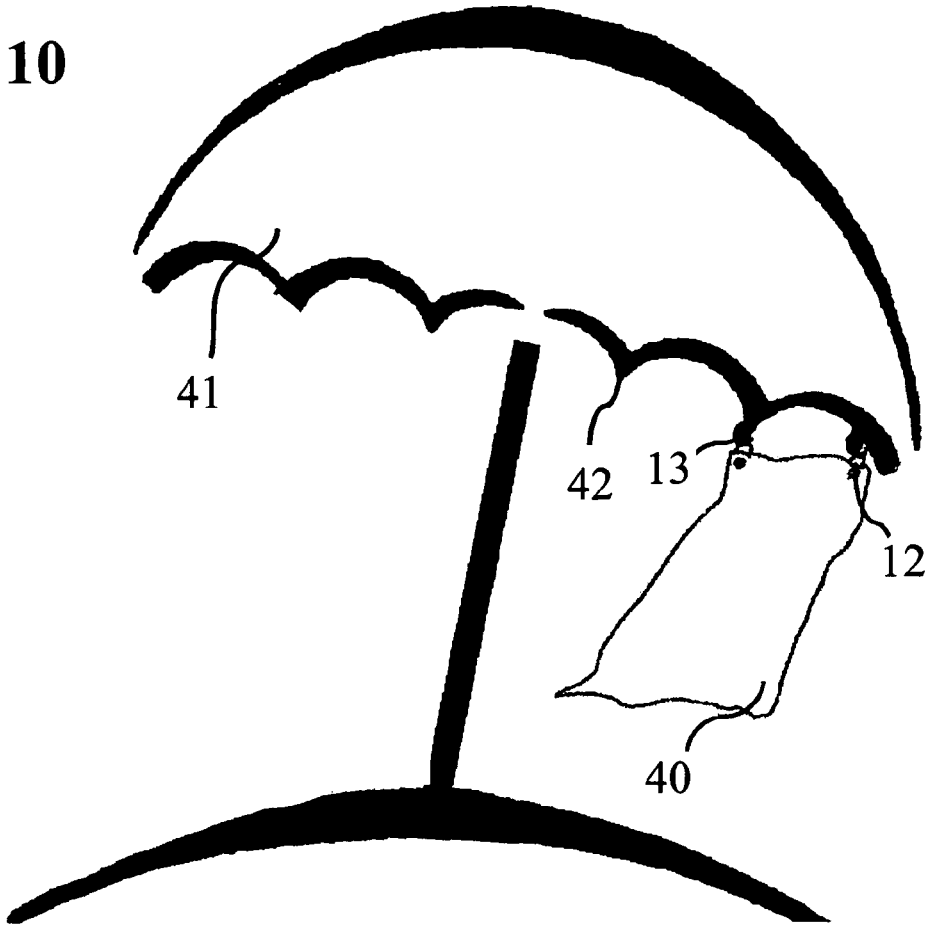
FIG. 10** is a schematic view of the Fastener Mechanism For Releasably Uniting Articles of Clothing showing another embodiment of the fastener mechanism functioning to unite related but different articles.
Figure 10:
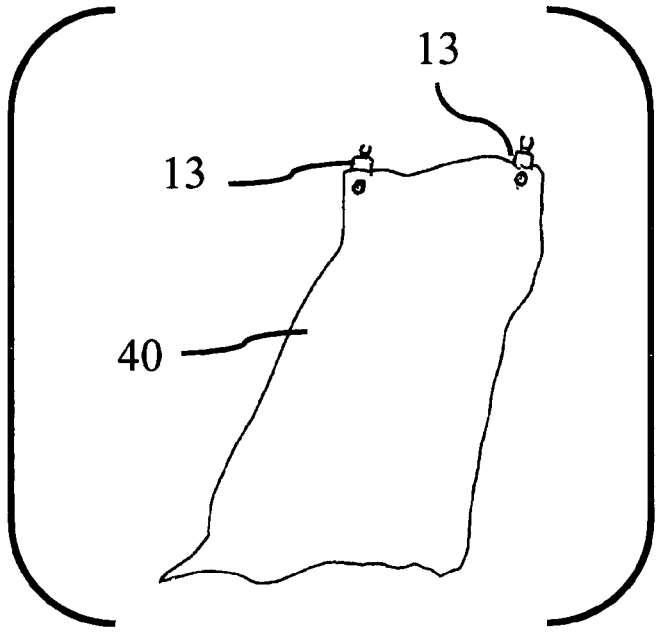

FIG. 10 is a schematic view of the Fastener Mechanism For Releasably Uniting Articles of Clothing showing another embodiment of the fastener mechanism functioning to unite articles that are not integral to a single article but are, instead, related distinct articles. A beach towel 40 is shown. The beach towel 40 has at least two second fastening components 13 attached to at least two corners of the beach towel 40. The beach umbrella 41 correspondingly has at least two first fastening components 12 attached to rim 42 of the beach umbrella 41. The beach towel 40 is conveniently fastened to the beach umbrella 41 for easy storage and drying in the sun, while further shading the beach goers. It will be understood by those skilled in the art that the fastener components 42 can be used for securing a bath towel fastened to a shower curtain or for attaching a scarf to a coat.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. A fastener mechanism for releasably uniting articles of clothing, comprising:

a. a first fastener component attached to a first article of clothing, said first fastener component comprising a first appending member and a projecting disk-shaped member having a body and a grooved portion extending circumferentially around said body;

b. a second fastener component attached to a second article of clothing, said second fastener component comprising a second appending member and a u-shaped member forming an aperture having an inner surface provided with a ribbed portion extending circumferentially therealong, said u-shaped aperture member and ribbed portion being adapted to receive and hold said disk-shaped member in interlocking relationship within the groove portion;

c. said first and second appending members comprising an attachment means for affixing said first and second fastener components to said first and second articles of clothing, whereby the fastening mechanism is engaged when the disk-shaped member of the first fastener component is inserted into the u-shaped member of the second fastener component, thereby joining the first and second articles of clothing together so as to maintain the union of the articles throughout laundering and storing thereof; and d. a band of material having two vertical sides being affixed to said first and second articles of clothing by an attachment means, said attachment means engaging each of said two vertical sides so that said band of material forms a pocket-like structure that functions to house said first and second fastener components.

2. A fastener mechanism for releasably uniting articles of clothing as recited by claim 1, wherein said first and second fastener components are composed of a thermostable plastic material.

3. A fastener mechanism for releasably uniting articles of clothing as recited by claim 1, wherein said articles of clothing are of a type that comes in pairs and are selected from the group consisting of socks, booties, mittens, gloves, and infant ouffits.

4. A fastener mechanism for releasably uniting articles of clothing as recited by claim 1, wherein said band of material having said two vertical sides and having a horizontal top side and a horizontal bottom side is affixed to the articles of clothing by an attachment means, said attachment means engaging each of said two vertical sides and said horizontal bottom side so that said band of material forms a pocket-like structure that functions to house said first and second fastener components.

5. A fastener mechanism for releasably uniting articles of clothing as recited by claim 1, wherein said band of material has an outer surface including a design or logo located thereon.

6. A fastener mechanism for releasably uniting articles of clothing as recited by claim 1, wherein said band of material has a shape in the form of a design or logo.

7. A fastener mechanism for releasably uniting articles of clothing as recited by claim 1, wherein said band of material is composed of an elastic material.

8. A fastener mechanism for releasably uniting articles of clothing as recited by claim 1, wherein said band of material has a height greater than or equal to the length of said first and second fastener components.

9. A fastener mechanism for releasably uniting articles of clothing as recited by claim 1, wherein said band of material has a length greater than or equal to the width of said first and second fastener components.

10. A fastener mechanism for releasably uniting articles of clothing as recited by claim 1, wherein said first and second appending members have at least two apertures therein that receive attachment means for affixing said first and second fastener components to said first and second articles of clothing, said attachment means comprising a sewing of threaded material.

11. A fastener mechanism for releasably uniting articles of clothing as recited by claim 10, wherein said threaded material is composed of an elastic material.

12. A fastener mechanism for releasably uniting articles of clothing as recited by claim 1, wherein said first fastening component has an aperture for receiving a decorative snap when the articles of clothing are being worn, said decorative snap is comprised of a face portion having a design and a back portion having a projection, and said projection is received by said aperture.

13. A fastener mechanism for releasably uniting articles of clothing as recited by claim 1, wherein said second fastening component has a u-shaped member forming an aperture for receiving a decorative disk shaped snap when the articles of clothing are being worn, said decorative disk shaped snap is comprised of a disk-shaped body and a trenched portion extends circumferentially around said body, and said decorative disk shaped snap is received by said u-shaped member.

14. A fastener mechanism for releasably uniting articles of clothing, comprising:

a. a first fastener component attached to a first article of clothing, said first fastener component comprising a first appending member and a projecting disk-shaped member having a body and a grooved portion extending circumferentially around said body;

b. a second fastener component attached to a second article of clothing, said second fastener component comprising a second appending member and a u-shaped member forming an aperture having an inner surface provided with a ribbed portion extending circumferentially therealong, said u-shaped aperture member and ribbed portion being adapted to receive and hold said disk-shaped member in interlocking relationship within the groove portion;

c. said first and second appending members comprising an attachment means for affixing said first and second fastener components to said first and second articles of clothing, whereby the fastening mechanism is engaged when the disk-shaped member of the first fastener component is inserted into the u-shaped member of the second fastener component, thereby joining the first and second articles of clothing together so as to maintain the union of the articles throughout laundering and storing thereof; and d. said second fastening component's said u-shaped member forming an aperture being further appointed for receiving a decorative disk shaped snap when the articles of clothing are being worn, said decorative disk shaped snap being comprised of a disk-shaped body and a trenched portion extending circumferentially around said body, and said decorative disk shaped snap being adapted to be received by said u-shaped member.

15. A fastener mechanism for releasably uniting articles of clothing as recited by claim 14, wherein said first and second fastener components are composed of a thermostable plastic material.

16. A fastener mechanism for releasably uniting articles of clothing as recited by claim 14, wherein said articles of clothing are of a type that comes in pairs and are selected from the group consisting of socks, booties, mittens, gloves, and infant outfits.

17. A fastener mechanism for releasably uniting articles of clothing as recited by claim 14, wherein said first and second appending members have at least two apertures therein that receive attachment means for affixing said first and second fastener components to said first and second articles of clothing, said attachment means comprising a sewing of threaded material.

18. A fastener mechanism for releasably uniting articles of clothing as recited by claim 14, wherein said first fastening component has an aperture for receiving a decorative snap when the articles of clothing are being worn, said decorative snap is comprised of a face portion having a design and a back portion having a projection, and said projection is received by said aperture.

* * * * *